US005327189A

United States Patent [19]

Wernicke et al.

[11] Patent Number: 5,327,189

[45] Date of Patent: Jul. 5, 1994

[54] DEVICE FOR DEVELOPING PHOTOGRAPHIC FILM BASES

[75] Inventors: Ubbo Wernicke, Roesrath-Kleineichen; Egon Bachem, Burscheid, both of Fed. Rep. of Germany

[73] Assignee: Agfa Gevaert Aktiengesellschaft, Leverkusen, Fed. Rep. of Germany

[21] Appl. No.: 859,732

[22] PCT Filed: Dec. 13, 1990

[86] PCT No.: PCT/EP90/02165

§ 371 Date: Jun. 8, 1992

§ 102(e) Date: Jun. 8, 1992

[87] PCT Pub. No.: WO91/10169

PCT Pub. Date: Jul. 11, 1991

[30] Foreign Application Priority Data

Dec. 21, 1989 [DE] Fed. Rep. of Germany ..... 3942394

[51] Int. Cl.[5] ..... G03D 3/08

[52] U.S. Cl. ..... 354/319; 354/321

[58] Field of Search ..... 354/319-324, 354/339, 331, 336; 134/64 P, 64 R, 122 P, 122 R; 271/207, 220

[56] References Cited

U.S. PATENT DOCUMENTS

| | | | |
|---|---|---|---|
| 3,699,869 | 10/1972 | Jensen | 354/321 |
| 3,785,269 | 1/1974 | Morioka | 354/322 |
| 4,362,376 | 12/1982 | Otani | 354/319 |
| 4,709,913 | 12/1987 | Cagey | 271/207 |

*Primary Examiner*—D. Rutledge

*Attorney, Agent, or Firm*—Connolly and Hutz

[57] ABSTRACT

The invention relates to a device for developing photographic film bases with a plurality of treatment tanks to be passed through consecutively, which treatment tanks are connected by transfer devices and of which at least one contains a developing fluid suitable for developing copies of negatives. In front of this developing tank in the direction of processing, a further treatment tank is disposed, having a bath fluid for reverse developing. In addition to the inlet aperture, the reverse developing tank is provided with a further inlet aperture, at the end of a guide bridging the reverse developing tank, to the treatment tank adapted for copies of negatives.

9 Claims, 2 Drawing Sheets

DEVICE FOR DEVELOPING PHOTOGRAPHIC FILM BASES

BACKGROUND OF THE INVENTION

The invention relates to a device according to the preamble of claim 1.

Developing apparatus of this kind is widely used, e.g. in connection with so-called mini-labs in which, from negatives, copies in the three colors are exposed on to so-called CN copying material by means of specified copying light quantities. Copies forming part of a single order are generally cut off in strips and are passed through so-called automatic developing apparatus with a plurality of treatment tanks containing different fluids, which are adapted to the particular copying material. Thus, for example in the well-known color-negative-positive process, color developing, in a so-called color developer, is followed by treatment in a bleaching fixing bath and then a subsequent treatment by rinsing or in a stabilizing bath. The copies, then dried, are cut into individual pictures and are passed on for final processing stacked according to each order.

Such a process is only suitable for a particular type of original, i.e. for negatives, which are copied on to a special CN paper, or for positives, slides, which are copied on to a special CT paper. In the latter case, a constant double exposure is additionally necessary over the whole film base surface, in addition to a reverse developing device upstream and rinses.

SUMMARY OF THE INVENTION

In German Patent Application P 38 39 573 (=A-G 5456), a photographic reversing process is described in which both types of originals can be exposed on to the same type of copy material, but have to be treated differently according to the type of exposure. The object of the invention is therefore to make the developing process such that, according to the type of exposure, different developing processes can be carried out in one and the same device.

This object is achieved in a device of the type mentioned in the introduction and having the characterizing features of claim 1.

The additional treatment tank upstream of the color developer tank of conventional filling is provided with a black-and-white developer. According to the intended holding time, length of tank and speed of operation, all baths can also be arranged as a multiple tank. The negative material exposed with the positive picture is therefore subjected to a black-and-white development before immersion in the color developer. In the reversing process conventional hitherto, masking of the residual silver halide is necessary after black-and-white development, which is carried out by chemical means after rinsing in a special masking bath or by a so-called double exposure before color development. According to a preferred embodiment of the invention, this masking of the residual silver halide is effected by a so-called double exposure, which is carried out after a certain time inside the color developing tank. In this case, it is significant that this double exposure is not effective until a few seconds after insertion of the photographic material into the color developer. In this way, high and optimum maximum densities of the individual colors, i.e. a high color saturation, can be obtained.

BRIEF DESCRIPTION OF THE DRAWINGS

Further details and advantages of the device according to the invention will appear from the subclaims in connection with the description of an embodiment, which is explained with the aid of Figures, in which:

DETAILED DESCRIPTION OF THE INVENTION

Figure 1:
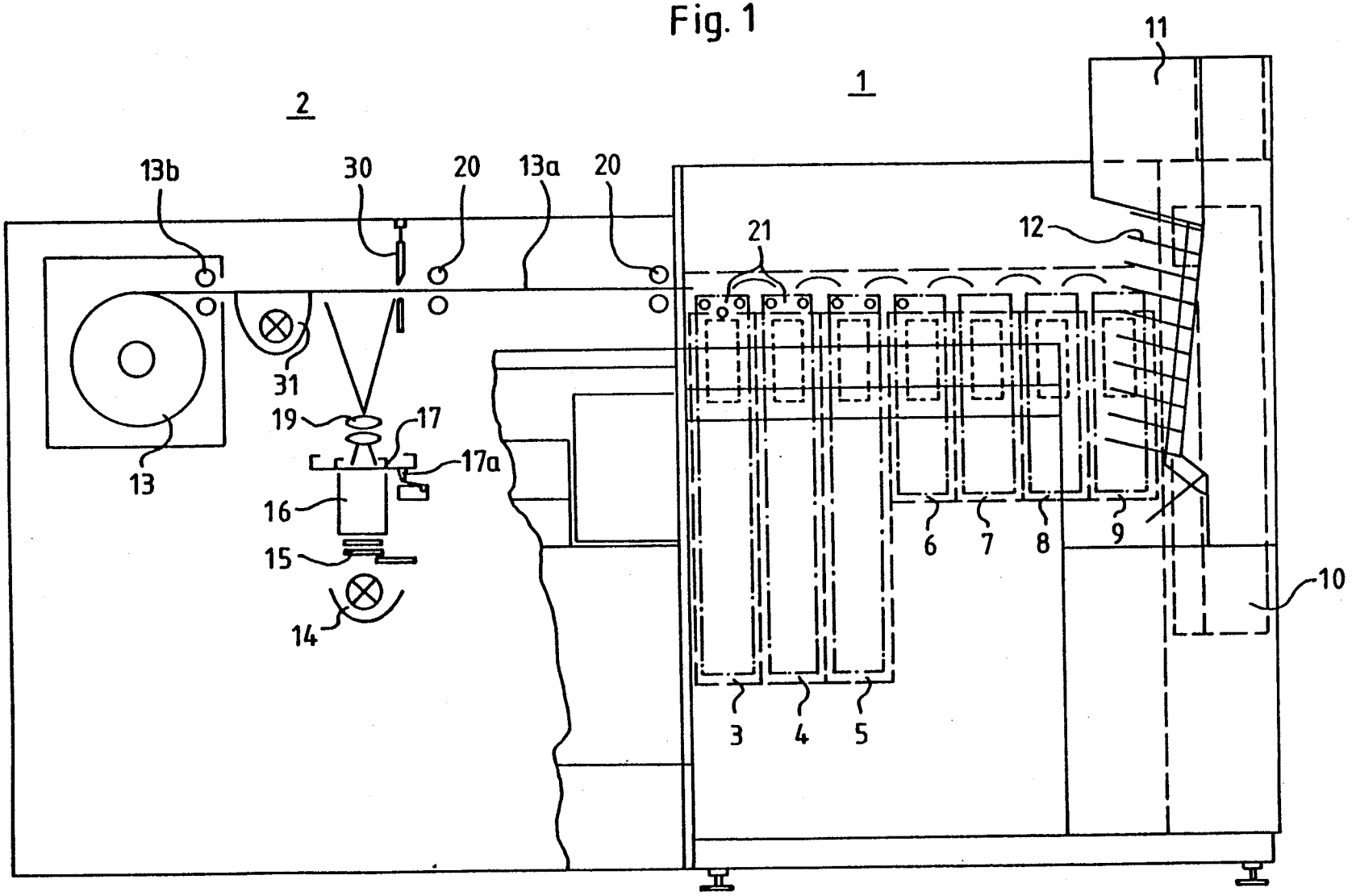
FIG. 1 shows a side view of a developing device according to the invention connected to a roller copying machine, FIG. 2, a diagram of the first two treatment tanks of the developing apparatus according to FIG. 1 viewed from the side with optional bridging of the reverse developing tank, FIG. 3, an alternative to the bridging of the reverse developing tank according to FIG. 2, and FIG. 4, a further embodiment of an optionally effective bridging of the reverse developing tank.

In FIG. 1, a developing device is shown in which the photographic material 13*a* from a roller copying machine 2 is passed through seven wet treatment tanks 3 to 9 consecutively, and then through a dryer 10. The speed of passage and length, i.e. holding time, of the photographic film bases in the individual treatment tanks are adapted to suit the respective processing data, i.e. a film base passing continuously through the containers at the prescribed speed is developed in the optimum manner. As a first developer, a black-and-white developer is contained in the reverse developing tank 3, and a color developer in the second tank 4, and a bleaching fixing bath is contained in the third tank referenced 5. The slightly more shortly formed tanks 6, 7, 8 and 9 each contain material for further processing, water or a stabilising bath. The dryer 10 is not described in more detail and is of conventional construction. A cutting device 11 is attached to its upper end, and is controlled by marks made on the paper strip 13*a*. A fan transporting chain with depositing fans 12 takes one stack of cut pictures at a time until it reaches the mark indicating the end of an order, after which the chain is moved on by one division.

Figure 2:
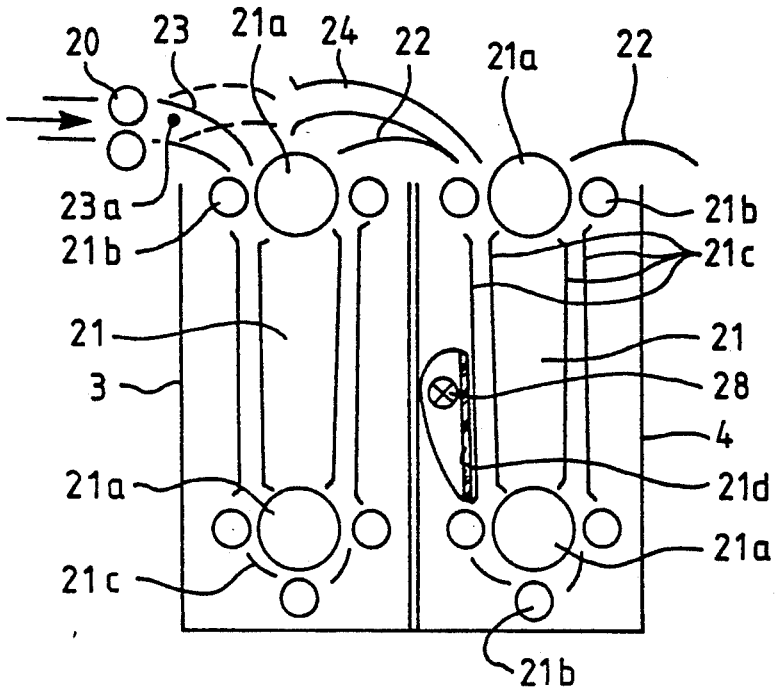

In each of the fluid-filled tanks 3 to 9 are so-called racks 21, which are shown in diagrammatic form in FIG. 2. Each rack contains two bars, not shown, which are connected together by stay bolts. Rotatably driven central rollers 21*a*, each associated with pressure rollers 21*b*, are mounted in the bars. Such central rollers are also located on the lower reversing point of the rack, but with three pressure rollers 21*c*. Guide plates 21*c*, which guide the advanced leading edge of the paper into the contact gaps of the subsequent roller pair, extend between the roller pairs 21*a* and 21*b*. Such guide plates 21 are only mounted between respective pressure rollers at the lower reversing points. The length of the guide plates 21*c* or the distance of consecutive transporting roller pairs 21*a, b* is such that the passing sections of paper strip are in each case longer than the distance between the roller pairs. If necessary, means are provided on a roller copying machine to ensure a suitable minimum length of the paper strip.

Between every two consecutive tanks 3 to 9, so-called bridging devices 22 are provided, which divert the leading end of the strip from the previous roller pair of the one tank into the contact gap of the first roller pair of the subsequent tank.

In the second treatment tank 4 for the color developer, at a certain distance from the liquid surface and at the bottom of the side of the guide plates facing the film side of the strip 13*a*, an area 21*d* can be transilluminated, e.g. by installing a translucent plastics window or by slots running transverse or oblique to the transport direction. On the outside of the region 21*d* which may be illuminated, a lighting device 28 is mounted, which extends over a relatively long part of the path for the strip 13*a*. But at the top, the lighting device is screened, so that the path of the strip is substantially free from the incidence of light from the lighting device at the top to the fluid surface. If necessary, as a light seal, a light-proofing roller pair penetrated by the paper 13*a* can be provided over the lighting device.

Going back to FIG. 1, the roller copying machine 2 shown in the left-hand part of FIG. 1 is described. On the left-hand edge of the light-proof housing, a roller paper cassette 13 is provided, which is equipped on the inside with a winding of negative copy material (CN), e.g. with chloride emulsion. Two conveyor rollers 13*b* push the leading end of the paper strip 13*a* into a suitable guide to the copying station.

In the copying station, the arrangement is as follows, from the bottom upwards, in the direction of the optical axis: a copier light source 14, whose luminous flux can be interrupted by a shutter, not shown, at the end of an exposure cycle; a color filter aggregate 15, which colors the path of the rays by a greater or smaller degree of insertion of maximum density color filters, or which, by complete insertion of subtractive or additive filters, to a certain extent acts as a color shutter for ending the individual color exposures; a mixing shaft 16, which is composed of inward-facing mirror surfaces and ensures even distribution of the uneven luminous flux found behind the filters; a platform 17 for the original, which is formed as a guide for a film strip or is replaceably formed as an insertable guide for framed slides, according to the type of originals. The stage for slides has a cam 17*a*, which actuates a sensor 18. Through an objective 19, finally the original located in the copying position is copied to the appropriate section of the copy material strip 13*a*. In addition to the support for the copy material, a cutting device 30 is provided, which is generally actuated at the end of a job. For further transport, two roller pairs 20 are provided, of which the first could also be mounted in front of the copying station in the direction of passage. The second transporting roller pair is mounted directly in front of the inlet into the developing device 1.

In FIG. 1, an additional exposure device 31, which after being switched on acts on the copy material 13*a* with a gradation-curving, monotone exposure, is disposed between the copying station and the cassette 13 and is aligned with the film side. Such an additional exposure device effects a flattening of the sensitivity curve of the photographic material and makes possible, e.g. the exposure of very contrasting slides on a relatively steep copy material, since the gradation curve is very flattened by this general exposure.

Figure 3:
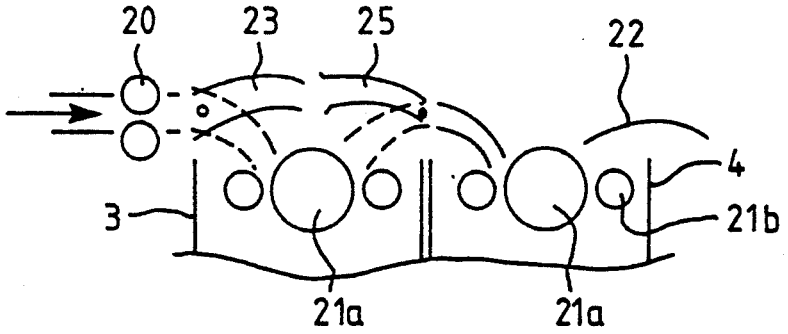
Figure 4:
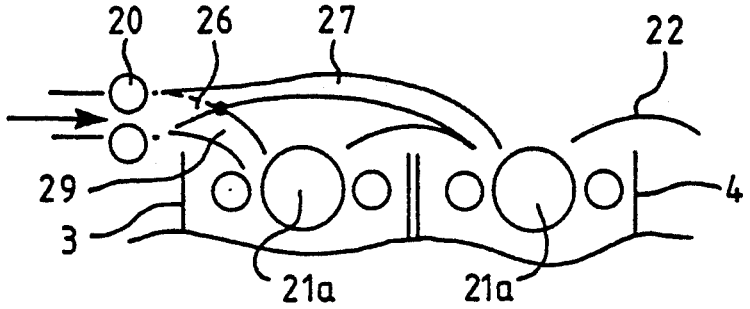

FIG. 2 to 4 show various means of conducting the strip of copy material conveyed by the rollers 20 into different treatment containers according to the type of exposure, from the negative or from a slide. FIG. 2 shows a two-part device 23, 24 for bridging the reverse developing tank 3, the first channel 23 being movable about an axis 23*a* from a position shown in broken lines for guiding the leading end of the paper into a fixed bridging part 24, into the position shown in solid lines for insertion of the leading end of the paper into the roller gap between the rollers 21*a*, 21*b* of the reverse developing tank. For copies of negative material, the reverse developing tank 3 can be bridged, i.e. the part 23 is brought into the position shown in broken lines, in which the leading end of the paper strip is guided by the part 24 between the rollers 21*a*, 21*b* of the second tank. For a paper strip on which slides have been exposed, the part 23 is pivoted into the lower end position, and the leading end of the paper is guided into the reverse developing tank.

FIG. 3 shows an alternative to the embodiment according to FIG. 2. The bridging device for the tank 3 here consists of two movable guide elements 23' and 25, both of which can be converted from a lower into an upper end position. In the lower end position, the part 25 shown in broken lines guides the leading end of the paper emerging from the tank 3 into the inlet aperture of the second tank 4.

A further modification is shown in FIG. 4. Here, the inlets to the run-up side roller gaps of the tank 3 and 4 are each formed as fixed channels 29 and 27 respectively, in which case, according to its position, a mobile switch blade 26 diverts the leading edge of the paper strip into the channel 27 to the tank 4 or into the channel 29 to the tank 3.

The moving parts according to FIGS. 2 to 4, i.e. the channels 23, 23', 25 and switch blade 26 are attached to a suitable electromagnetic or electric motor drive. The simplest embodiment would be direct coupling to an electric rotary magnet, which oscillates between the two end positions. A kinematically more advantageous solution is to connect up a dead center drive, which reduces the power requirement at the start and the forces for braking at the end of the movement. Generally, however, these solutions with a magnet have the disadvantage that, in one of the two positions, the magnet has to be constantly supplied with current in order to absorb the force of the restoring spring. A further possibility without this disadvantage is therefore to realize this by a reversing motor with a corresponding reducing gear unit and with end switches in the two end positions.

The mode of operation of the device described is the following:

Generally, the more common type of original is a negative in the form of a strip, for which a suitable removable platform 17 is inserted into the copying machine 2. For this use, the device for below-threshold pre-exposure 31 is ineffective and the exposure control for controlling the filter aggregate 15 and a shutter is actuated by stored values for the paper sensitivity, which correspond to the conventional negative processing. In the developing device 1, the moving parts 23, 23' and 25 and switch blade 26 are in the position which guides the leading end of a paper strip directly into the second tank 4, while the device 28 for double exposure switched off.

If positive originals are then processed, a series of conversion processes is necessary. If the slides are in strip form, it is not necessary to change the platform 17 for the originals. The conversions on the machine must then be carried out manually. Generally, however, slides in plastics frames are presented, which require a special platform for originals in the manner of the clip in a slide projector. Such platforms are known in many forms. The replaceable platform 17 for framed slides actuates with its cam 17*a* the sensor 18, which provokes the following conversion processes. The store for the sensitivity of the copy material is converted to the values necessary for the exposure of slides. The general exposure device 31 exposes the paper to be advanced at the intensity required to flatten the gradation for slides. This quantity of light may also be variable according to the density range of the original. This exposure may be carried out simultaneously with the main exposure.

By the electric drives, the moving parts 23, 23' and 25 and the switch blade 26 are moved into the position in which they guide the leading edges of the copy material into the reverse developing tank 3. Finally, this exposure device 28 is switched on with a delay sufficient to move the end of the last material exposed with negative originals to the reverse exposure device 28. Thus the developing device 1 is ready to receive CN material on to which positive originals, in particular slides, have been copied.

To convert from the state suitable for copying slides to the state for copying negatives, the adjustment procedures described are reversed, and the exposure device 28 must be switched off after an appropriate delay, so that the last picture copied from a slide has received sufficient light from the exposure device 28.

The conversion procedures are in any case simplified if the cutting device 30 is actuated before conversion, so that the last picture exposed according to the preceding-type of exposure has passed through the first two tanks of the developing device by the time processing of the new type of original starts.

We claim:

1. Device for developing photographic film bases comprising a plurality of treatment tanks for film bases to be passed through consecutively, said treatment tanks having inlet apertures and being connected by transfer devices and guides, wherein at least one of said treatment tanks is a negative copy developing tank which contains a developing fluid suitable for developing copies of negatives, and further wherein a reverse developing tank containing a fluid bath for reverse developing is disposed in front of said negative copy developing tank in the direction of processing, a first movable guide element on the guide paths to the inlet apertures of different developing tanks, wherein said movable guide element is capable of switching between the guide paths leading to different developing tanks, a guide bridging the reverse developing tank and ending at the inlet aperture of the negative copy developing tank, wherein the guide bridging the reverse developing tank is divided into a first part and a second part, the first part comprising a convertible guide channel and the second part comprising a movably mounted element acting in one position to divert the film base emerging from the reverse developing tank to the negative copy tank.

2. Device according to claim 1, wherein said first movable guide element is a switch blade between two different fixed guide channels which lead to the inlet apertures of the reverse developing tank and the negative copy developing tank.

3. Device according to claim 1 or 2, wherein an exposing device which is disconnectable for the double exposure of the photographic film base is provided on the side of the negative copy development tank facing the film side of the photographic material at a certain minimum distance from the inlet aperture.

4. Device according to claim 3, wherein a guide plate mounted between transporting rollers can be transilluminated in the region of the exposure device through slots running transverse or oblique to the transport direction, or transparent plastic parts.

5. Device according to claim 3 wherein the developing device is connected to a roller copying machine, and the exposure device is activated by a switch coupled to a control element, whereby said control element adapts the roller copying machine to the type of original to be processed.

6. Device according to claim 5, wherein a delay member is provided between the control element for adapting the roller copying machine to the type of original to be processed and the switch for the exposing device whereby the switching on and off of the exposed devices takes place when the leading end of the film base with the copy of the new type of original arrives at the exposure device.

7. Device according to claim 5, wherein a platform for framed slides is insertable into the roller copying machine and actuates a sensor, whereby the drive for said first movable guide element for adapting the roller copying machine to positive originals and delayed actuation of the exposure device is controlled.

8. Device according to claim 5, wherein a second exposure device for gradation-curving, homogeneous additional exposure is provided upstream of the developing device in the path of the copy material and is actuated by processing positive originals.

9. A device as claimed in claim 1, wherein the first movable guide element is connected to an electric drive.

* * * * *